US011691451B2

(12) United States Patent
Golovata

(10) Patent No.: US 11,691,451 B2
(45) Date of Patent: Jul. 4, 2023

(54) GREETING CARD HAVING INTEGRATED MEMENTO

(71) Applicant: Ganna Golovata, Hanover, MD (US)

(72) Inventor: Ganna Golovata, Hanover, MD (US)

( * ) Notice: Subject to any disclaimer, the term of this patent is extended or adjusted under 35 U.S.C. 154(b) by 123 days.

(21) Appl. No.: 17/085,340

(22) Filed: Oct. 30, 2020

(65) Prior Publication Data

US 2021/0046778 A1 Feb. 18, 2021

Related U.S. Application Data

(63) Continuation-in-part of application No. 16/694,753, filed on Nov. 25, 2019, now Pat. No. 11,312,173.

(60) Provisional application No. 62/771,549, filed on Nov. 26, 2018.

(51) Int. Cl.

| | |
|---|---|
| ***B42D 15/04*** | (2006.01) |
| ***G09F 1/00*** | (2006.01) |
| ***G09F 7/02*** | (2006.01) |

(52) U.S. Cl.

CPC ..... *B42D 15/045* (2013.01); *B42D 15/042* (2013.01); *G09F 1/00* (2013.01); *G09F 7/02* (2013.01)

(58) Field of Classification Search

CPC .... B42D 15/045; B42D 15/042; B42D 15/04; B42D 15/02; G09F 7/02; G09F 1/00; G09F 1/04; G09F 3/10; G09F 2003/023; G09F 2003/0285; A63H 3/08; A63H 33/38; A63H 33/22; A63F 9/0613; A63F 9/1044; A63F 2009/0049

USPC ..... 40/124.19, 124.191, 124.01, 124.09, 40/124.11; 434/161, 176, 348; 446/147–151; 428/187; 273/157 R

See application file for complete search history.

(56) References Cited

U.S. PATENT DOCUMENTS

| | | | | |
|---|---|---|---|---|
| 2,844,901 A * | 7/1958 | Eisen | A63H 33/22 | 40/748 |
| 3,798,806 A * | 3/1974 | Sanford | B42D 15/022 | 40/124.03 |
| 4,200,222 A * | 4/1980 | Feuer | B42D 15/045 | 40/594 |
| 4,380,128 A * | 4/1983 | Ichikawa | B42D 15/045 | 40/775 |

(Continued)

FOREIGN PATENT DOCUMENTS

| | | | |
|---|---|---|---|
| DE | 202016006671 U1 * | 1/2017 | |
| GB | 2106034 A * | 4/1983 | B42D 15/042 |

OTHER PUBLICATIONS

English Translated DE-202016006671-U1 (Year: 2017).*

*Primary Examiner* — Jonathan Liu
*Assistant Examiner* — Rachel Mae Griffith
(74) *Attorney, Agent, or Firm* — Allen F. Bennett; Bennett Intellectual Property; Kaela Stephano

(57) ABSTRACT

A greeting card has a removable memento. The greeting card is one or more panels having a cutline extending entirely through the thickness of the greeting card. The portion of the card having a periphery defined by the continuous cutline acts as a. The greeting card may also have a coextensive second layer formed from paper, poster board, cardboard, a wooden panel, a photograph and the like. The greeting card may also be have two equally sized wooden panels attached to the same side of a second layer capable of forming a bendable hinge or joint between the two panels, allowing the two wooden panels to be rotated about the hinge 180° or 360°.

4 Claims, 11 Drawing Sheets

(56) References Cited

U.S. PATENT DOCUMENTS

| | | | | |
|---|---|---|---|---|
| 4,840,275 | A * | 6/1989 | Faiola | B65D 73/0092 229/92.8 |
| 6,413,617 | B1 * | 7/2002 | Schlier | G09F 3/0288 40/124.11 |
| 2004/0079006 | A1 * | 4/2004 | Shea | G09F 1/00 40/124.12 |
| 2005/0160638 | A1 * | 7/2005 | Donnelly | G09F 1/00 283/117 |
| 2008/0196284 | A1 * | 8/2008 | Stagg | B42D 15/006 40/124.04 |
| 2010/0223824 | A1 * | 9/2010 | Mandelbaum | B42D 15/042 40/463 |
| 2011/0016757 | A1 * | 1/2011 | Beckett | B42D 15/045 83/13 |
| 2015/0332611 | A1 * | 11/2015 | Yeh | B44C 5/06 40/124.08 |

* cited by examiner

Fig. 16
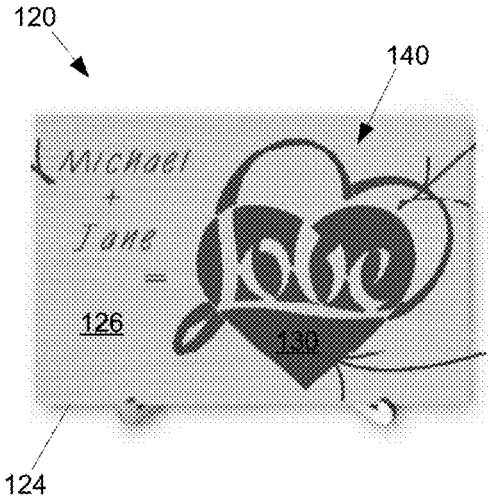
Fig. 17
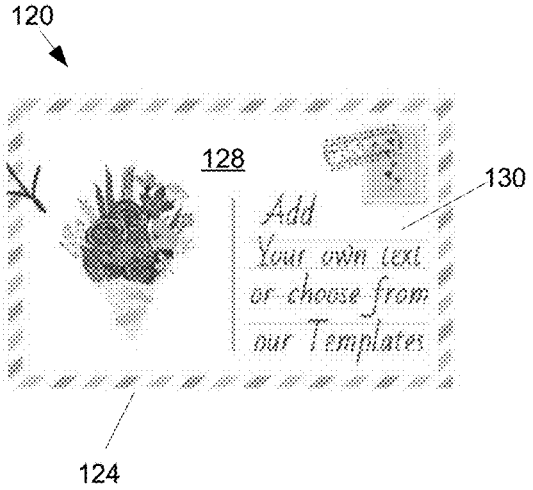
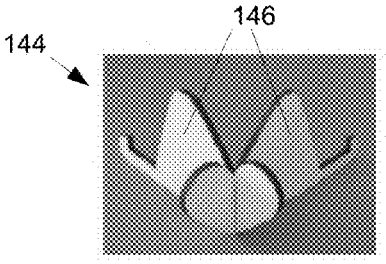
Fig. 18
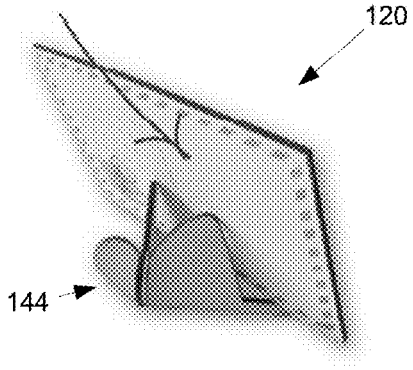
Fig. 19

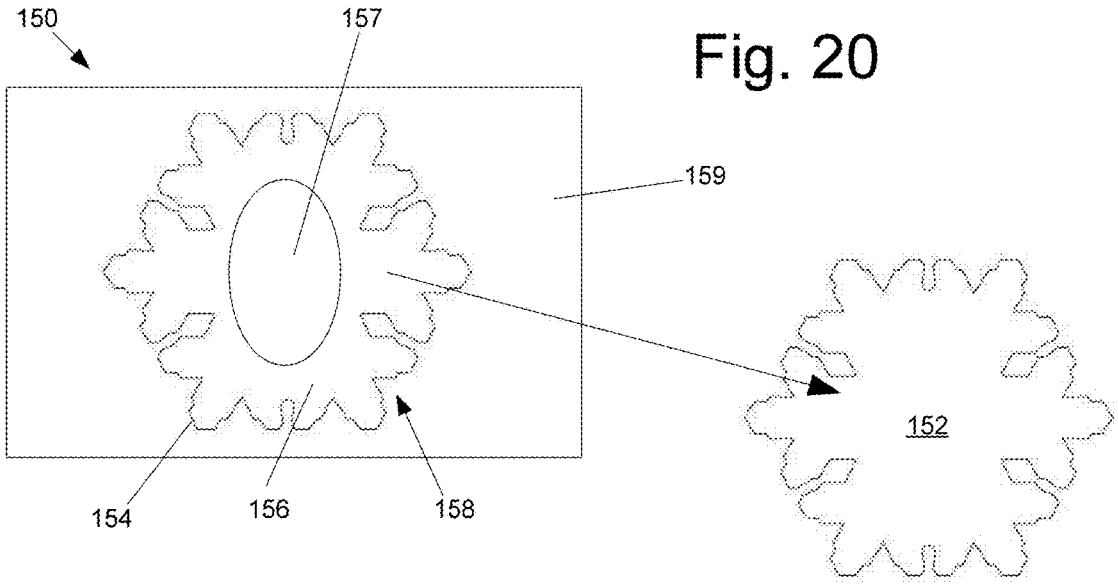
Fig. 20
Fig. 21
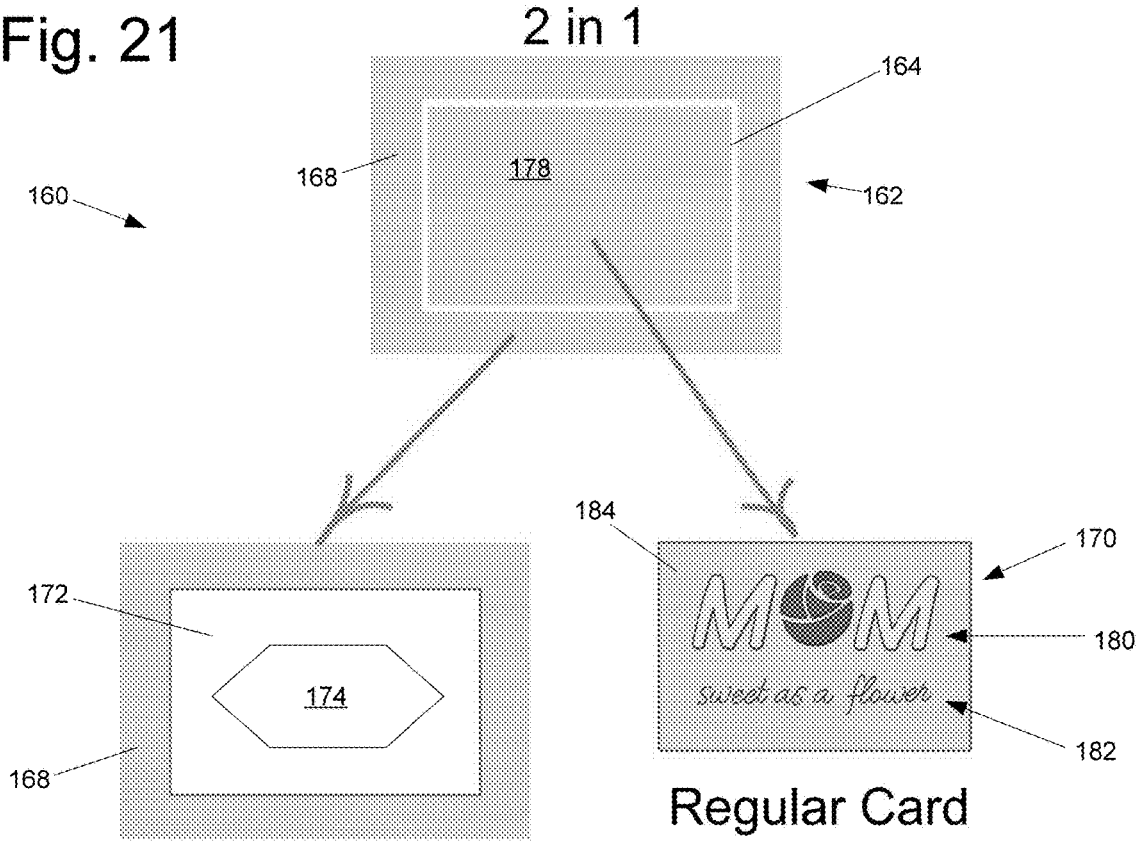

Fig. 26
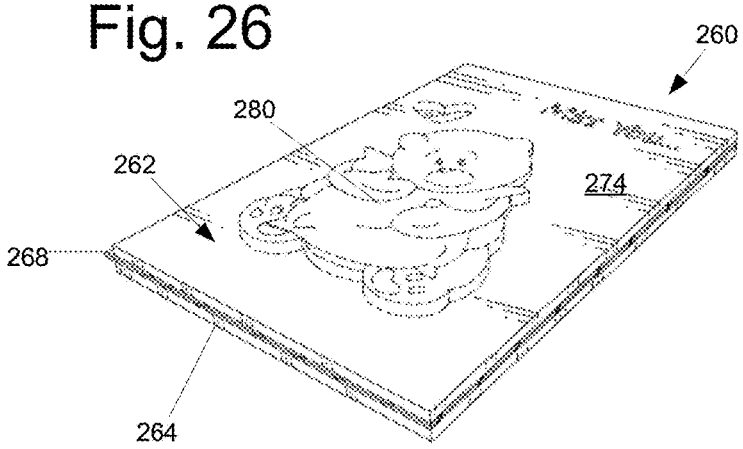
Fig. 27
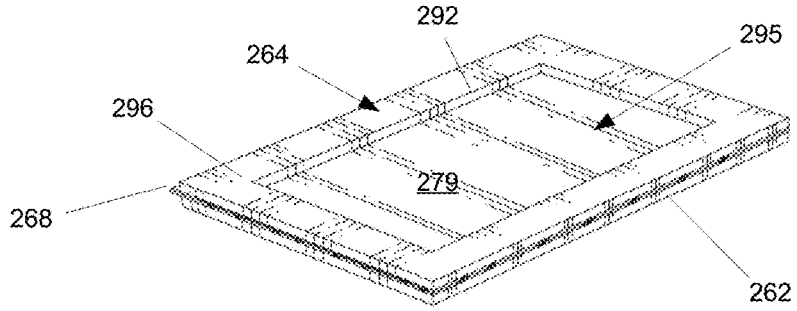
Fig. 28
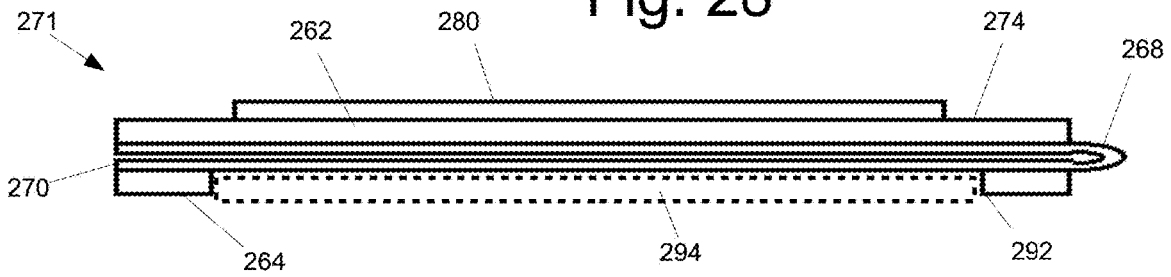
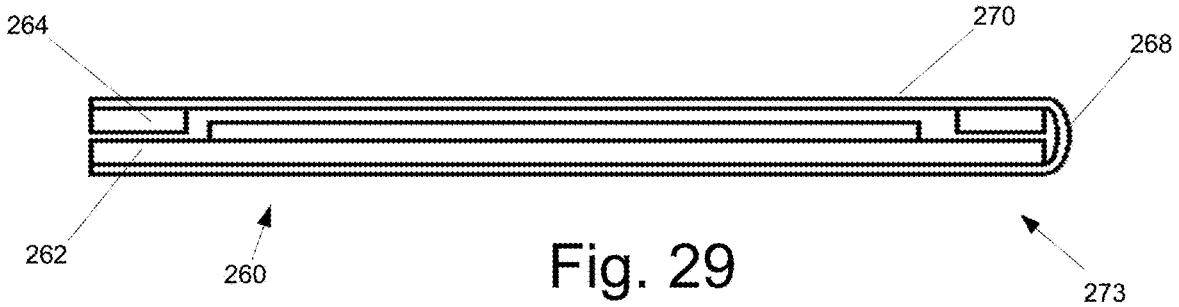
Fig. 29

GREETING CARD HAVING INTEGRATED MEMENTO

CROSS-REFERENCE TO RELATED APPLICATIONS

This application is a Continuation-in-Part of Utility patent application Ser. No. 16/694,753 filed on Nov. 25, 2019 and claims priority to U.S. Provisional Application Ser. No. 62/771,549 filed on Nov. 26, 2018.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to greeting cards. More particularly, the invention relates to greeting cards having multiple components such as a memento and which may be displayed in a variety of configurations.

Description of the Related Art

There are a variety of designs for greeting cards on today's market. In addition to having the greeting card convey an appropriate message, today's cards attempt to capture attention by means of their design or their ability to entertain. Since greeting cards are generally made from paper material, many greeting cards fills this need by combining their greeting cards with some commemorative item such as a gift, audio, an ornament or jewelry. The memento item is usually either separated from the gift card or may be attach as part of the card. While there are many ways to combine greeting cards with keepsake items, none of them have been designed as a full combination system. Also, many greeting cards are design to be separated once and serve only one purpose which may bored the user in time. Further, some greeting gift systems are a combination of two unrelatable elements, one of which may be of higher value than the other, which may draw away from the message that is presented.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a gift card system having multiple configurations that can be used for multiple purposes. It is also desirable to provide gift card elements that are separable yet pairable.

BRIEF SUMMARY OF THE INVENTION

Disclosed are systems and devices providing a greeting card having a removable memento for use in a variety of manners. The greeting card is typically formed from a similar material and has a continuous cutline extending entirely through the thickness of the greeting card. The portion of the card having a periphery defined by the continuous cutline acts as a memento and may be removed from the greeting card. The memento may be used for a variety of functions such as a Christmas ornaments, a dependence, a coaster, a refrigerator magnet, a keepsake and the like. The greeting card may consist only of a wooden panel having the continuous cutline. The greeting card may also be a wooden panel with a coextensive second layer formed from paper, poster board, cardboard, a wooden panel, a photograph and the like. The greeting card may also be comprised of two equally sized wooden panels attached to the same side of a second layer capable of forming a bendable scene or joint between the two wooden panels, allowing the two wooden panels to be rotated about the hinge 180° or 360°. In some embodiments, when the memento is removed from a wooden panel, the wooden panel becomes a frame for an image that was previously hidden by the memento prior to it being removed. In some embodiments, one of the wooden panels is a frame having a relatively large open area designed to accommodate a raised area on a second panel when the two panels are folded together.

It is therefore an object of the present invention to provide a greeting card having expanded functionality.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 16 is a front view of an alternative embodiment of a greeting card in accordance with the principles of the invention;

FIG. 17 is a rear view of an alternative embodiment of a greeting card in accordance with the principles of the invention;

FIG. 18 is a perspective view of a display stand for a greeting card in accordance with principles of the invention;

FIG. 19 is a perspective view of a greeting card on a display stand in accordance with principles of the invention;

FIG. 20 is a front view of an alternative embodiment of a greeting card in accordance with the principles of the invention;

FIG. 21 is a front view of an alternative embodiment of a greeting card in accordance with the principles of the invention;

FIG. 26 is a perspective view of an alternative embodiment of a greeting card in accordance with the principles of the invention;

FIG. 27 is another perspective view of an alternative embodiment of a greeting card in accordance with the principles of the invention;

FIG. 28 is a cutaway view of an alternative embodiment of a greeting card in an open configuration in accordance with the principles of the invention;

FIG. 29 is a cutaway view of an alternative embodiment of a greeting card and a closed configuration in accordance with principles of the invention;

DETAILED DESCRIPTION

Figure 1:
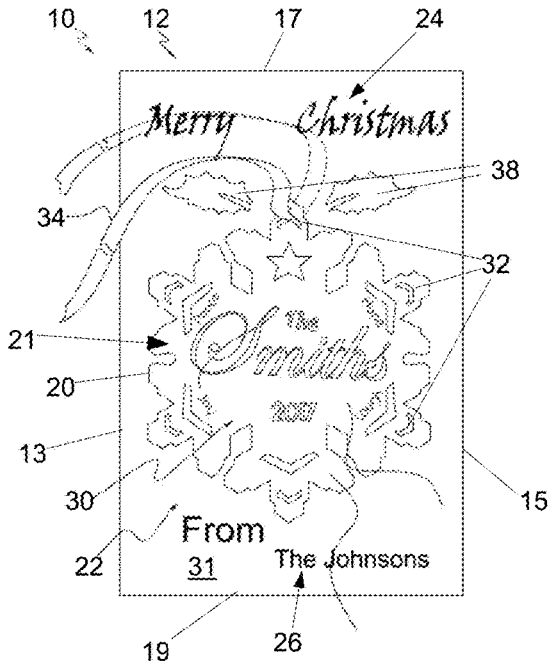
FIG. 1 is a front view of a greeting card in accordance with the principles of the invention.
Figure 2:
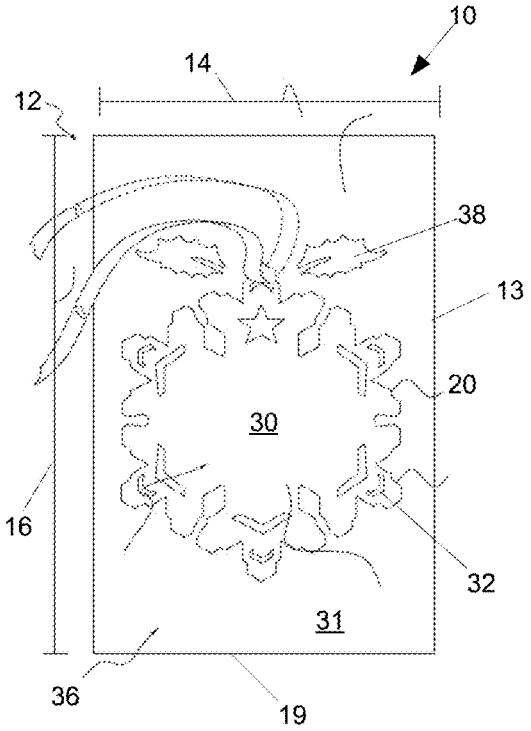
FIG. 2 is a back view of a greeting card in accordance with the principles of the invention.
Figure 3:
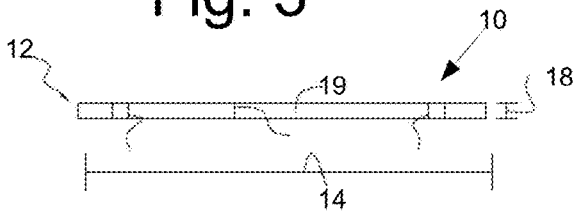
FIG. 3 is a bottom plan view of a greeting card in accordance with the principles of the invention.
Figure 4:
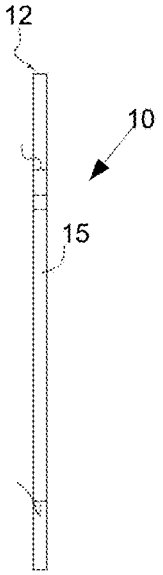
FIG. 4 is a side elevation view of a greeting card accordance with principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein. Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure. For example, unless it is clear from the context, all of the panels described herein are interchangeable.

Unless otherwise indicated, all numbers expressing quantities of ingredients, dimensions reaction conditions and so forth used in the specification and claims are to be understood as being modified in all instances by the term "about". The term "a" or "an" as used herein means "at least one" unless specified otherwise. In this specification and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

The panels of the various embodiments of the invention are often described as "wooden panels." However, this language is for convenience and should not be considered limiting. Unless explicitly stated otherwise, the various panels of the invention may be comprised of a variety of materials such as plastics, cellulose materials and the like. The panels are preferably formed from a rigid material but my optionally be formed from a semirigid materials. The cut lines of the embodiments are often referred to as "continuous cutlines." As used herein, the term "continuous" refers to a cutline which completely encloses an area on the panel such that the mementos are not physically directly connected to the frame portions of the panels. The term "sheet" refers to any thin material which may be adhered to one side of one or more panels. Where a sheet is attached to two or more panels, the sheet is capable of sufficiently bending or folding to form a hinge.

Disclosed are systems and devices providing a greeting card having a removable memento for use in a variety of manners. The greeting card is typically formed from a similar material and has a continuous cutline extending entirely through the thickness of the greeting card. The portion of the card having a periphery defined by the continuous cutline acts as a memento and may be removed from the greeting card. The memento may be used for a variety of functions such as a Christmas ornaments, a pendant, a coaster, a refrigerator magnet, a keepsake and the like. The greeting card may consist only of a wooden panel having the continuous cutline. The greeting card may also be a wooden panel with a coextensive second layer formed from paper, poster board, cardboard, a wooden panel, a photograph and the like. The greeting card may also be comprised of two equally sized wooden panels attached to the same side of a second layer capable of forming a bendable hinge or joint between the two wooden panels, allowing the two wooden panels to be rotated about the hinge 180° or 360°. In some embodiments, when the memento is removed from a wooden panel, the wooden panel becomes a frame for an image that was previously hidden by the memento prior to it being removed. In some embodiments, one of the wooden panels is a frame having a relatively large open area designed to accommodate a raised area on a second panel when the two panels are folded together.

FIGS. 1-4 show an exemplary greeting card 10 in accordance with the principles of the invention. The greeting card 10 is formed from a planar wooden panel 12 having a width 14, a length 16 and a thickness 18. In this embodiment, the planar wooden panel 12 is substantially rectangular, having an edge formed by two lateral sides 13 and 15, a top 17 and a bottom 19. Optionally, the rectangular wooden panel 12 may have any variety of shapes, with corners that are sharp or rounded and sides, top and bottom that are straight or curved. In this embodiment, the wooden panel 12 also has a substantially uniform thickness 18. Optionally, it may be desirable to have greeting cards having a non-uniform thickness. The wooden panel 12 includes a continuous cutline 20 surrounding and defining an ornamental, removable memento 30. In this embodiment, the ornamental, removable memento 30 has the shape of a snowflake. Optionally, the memento 30 may have any ornamental shape so long as it is removable from the panel 12. The portion of the panel 12 that is not part of the memento 30 is referred to herein as the frame 31 because it frames the memento 30.

The front surface 22 of the panel 12 may optionally include one or more decorative elements, text, or other two-dimensional shapes. The front surface 22 of the exemplary greeting card 10 includes the salutation "Merry Christmas" 24 and the specific text 26 "from the Johnsons." The memento 30 also includes the text "The Smiths 2017" 21 as well as the words "Peace," "Hope," "Joy," and "Laugh" at different regions of the memento 30. The continuous cutline 20 extends through the entire thickness of the panel 12 from the front surface 22 to the back surface 36 such that the memento 30 may be removed. In this embodiment, the memento 30 includes a plurality of openings 32 through which a ribbon 34 may be placed so that the memento 30 may be used as an ornament for a Christmas tree. The wooden panel 12 also includes decorative openings 38, which in this case are shaped like leaves and contribute to the aesthetic qualities of the greeting card 10. Although not shown, the surface of the wooden panel 12 may include text or decorative features as well. In use, the greeting card 10 may be packaged within an envelope and sent to a desired recipient. Alternatively, the greeting card 10 may be hand-delivered or left in a predetermined location in order to transfer possession of the card 10. In this embodiment, as with others, multiple mementos 30 may be incorporated into a single panel 12. For clarity, the exemplary embodiments shown herein are shown with only a single memento 30.

Figure 5:
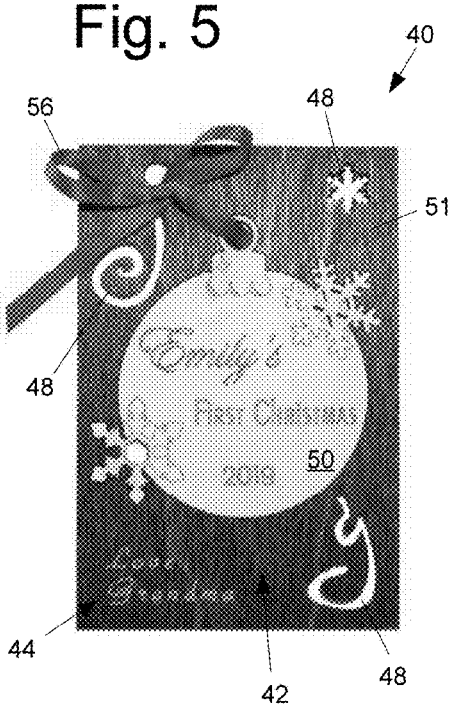
FIG. 5 is a front view of an alternative embodiment of a greeting card in accordance with the principles of the invention.
Figure 6:
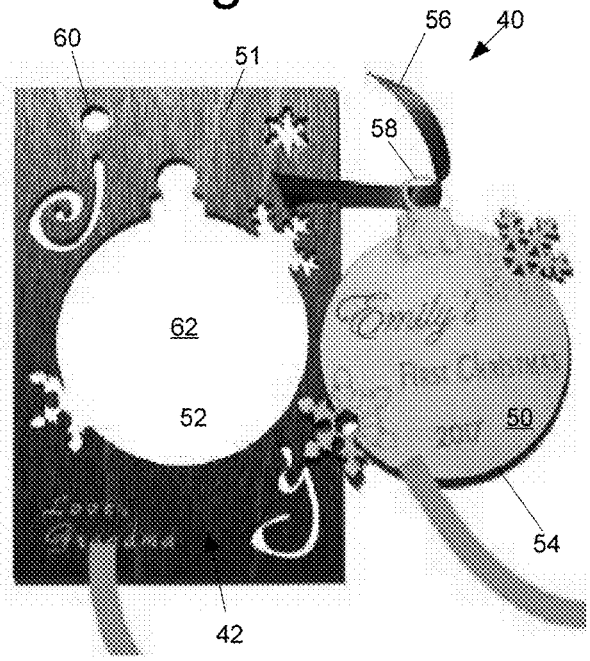
FIG. 6 is another front view of an alternative embodiment of a greeting card in accordance with the principles of the invention.

FIGS. 5 and 6 show an alternative embodiment of a greeting card 40 in accordance with principles of the invention. The greeting card 40 includes a front surface 42 having text 44 and decorative openings 48. A memento 50 is defined by a continuous cutline 52, which also defines the periphery 54 of the memento 50. In this embodiment, the memento 50 has a different finish than the frame 51 on the front surface 42 of the card 40. Either the frame 51 or the memento 50 may be treated with the same or different dye, paints, wood stain, varnish or other material so that the memento 50 and frame 51 have differences in appearance. Greeting card 40 also include a ribbon 56 extending through an opening 58 in the memento 50 and a decorative opening 60 in the frame 51. This allows the ribbon 56 to be integrated into the greeting card 40 and a manner that assists in keeping the memento 50 and the frame 51 connected as well as providing an aesthetically pleasing appearance. FIG. 6 shows memento 50 removed from the frame 51 and thus providing an opening 62 defined by the cutline 52.

Figure 7:
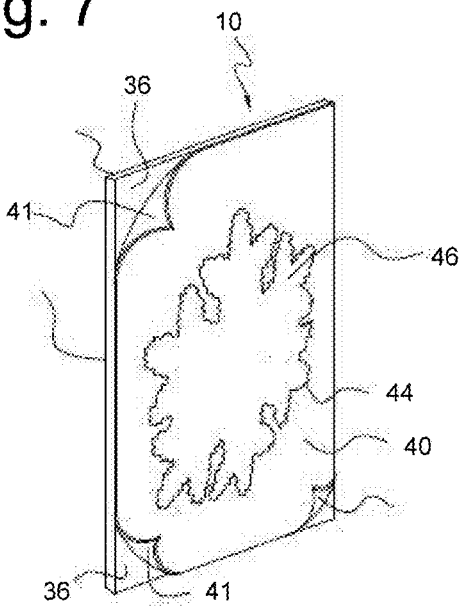
FIG. 7 is a perspective view of a greeting card having a sheet laminated onto its back side in accordance with the principles of the invention.

FIG. 7 shows the greeting card 10 modified by laminating a sheet 40 onto the back surface 36 of the panel 12. The laminated sheet 40 is coextensive with the back surface 36 of the panel 12. In this embodiment, a laminated sheet 40 includes a perforated, or noncontinuous, cutline 44 on the laminated sheet 40 congruent with the cutline 20 of the wooden panel 12. The noncontinuous, i.e. perforated, cutline 44 defines a region 46 congruent with and laminated onto the memento 30. The sheet 40 in this embodiment is laminated to the panel 12 using an adhesive to affix the attached side 41 of the sheet 40 to the back surface 36. The sheet 40 may be formed from paper, cardboard, posterboard, cloth or other substantially planar material, may be a single color or multi-colored, and may include decorative patterns or images.

The laminated sheet 40 may optionally include an address, return address, postage and the like so that the modified greeting card 10 may be mailed as a postcard. Because both the memento 30 and the panel 12 are attached to the paper sheet 40, they are held together by means of the perforated line 44 of the laminated paper sheet 40. This prevents the memento 30 from separating from the wooden panel 12. Upon receipt of the card 10, a person may remove the memento 35 punching through the perforated line 44. The region 46 defined by the continuous perforated line 44 remains attached to the memento 30 while the remainder 41 of the laminated paper sheet 40 remains affixed to the frame 31.

Figure 8:
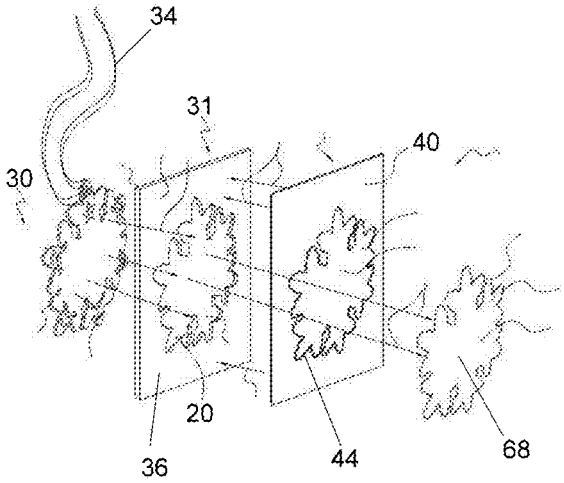
FIG. 8 is an exploded view of a greeting card having a sheet and a magnetic sheet laminated onto its back side in accordance with the principles of the invention.

FIG. 8 shows the greeting card 10 modified by the addition of a sheet 40, as shown in FIG. 7, and further modified by the addition of a magnetic panel 68 affixed to the region 46 of the sheet 40. The magnetic panel 68 may be coextensive with or smaller than the region 46.

Figure 9:
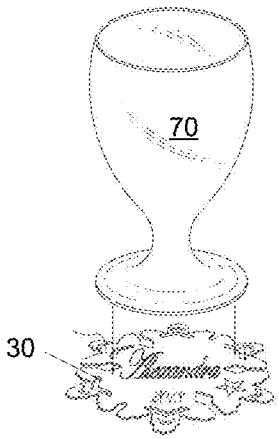
FIG. 9 is a perspective view of a memento of a greeting card used as a coaster in accordance with the principles of the invention.
Figure 10:
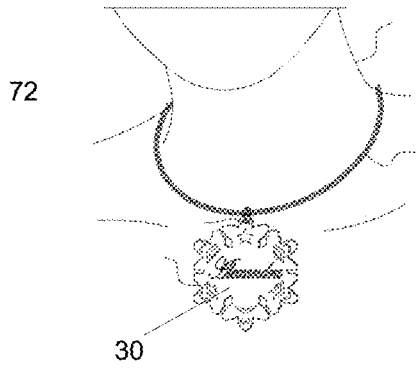
FIG. 10 is an environmental view of a memento of a greeting card used as a pendant on a necklace in accordance with principles of the invention.
Figure 11:
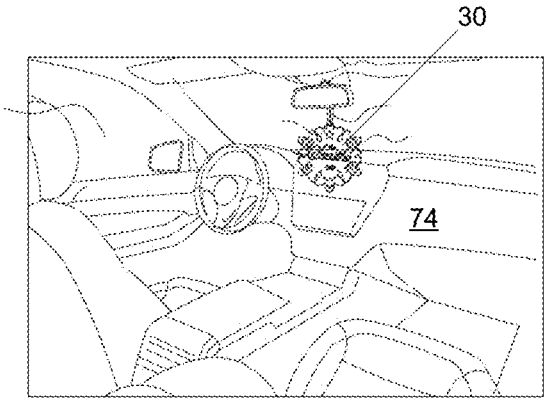
FIG. 11 is environmental view of a memento of a greeting card used as an air freshener in an automobile in accordance with principles of the invention.
Figure 12:
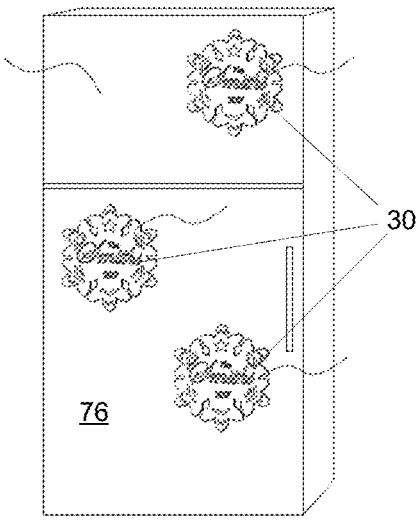
FIG. 12 is an environmental view of a memento of a greeting card used as a refrigerator magnet in accordance with the principles of the invention.

FIGS. 9-12 show some exemplary uses suitable for any of the mementos described herein. FIG. 9 shows the memento 30 being used as a coaster for a drinking glass 70. FIG. 10 shows the memento 30 being used as a pendant on a necklace 72. FIG. 11 shows the memento 30 being used as an air freshener in an automobile 74. Those skilled in the art will appreciate that wood may be infused with a scented material such as essential oils. Essential oils may occasionally need to be re-applied to the memento 30, but this property of the wood allows it to be utilized as an air freshener. FIG. 12 shows a plurality of mementos 30 modified as shown in FIG. 8 to include a magnetic panel and being used as refrigerator magnets on a refrigerator 76. Mementos modified to include a magnetic panel may be displayed on any metallic or magnetic surface.

Figure 13:
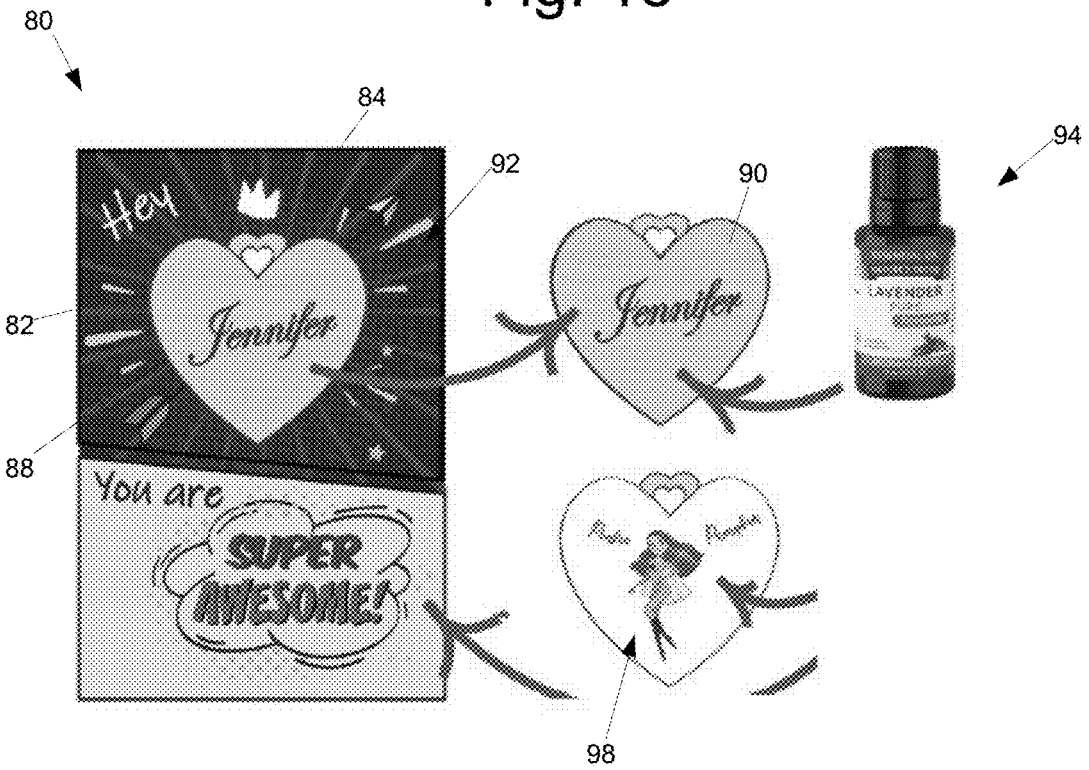
FIG. 13 is an exploded view of an alternative embodiment of a greeting card in accordance with the principles of the invention.
Figure 14:
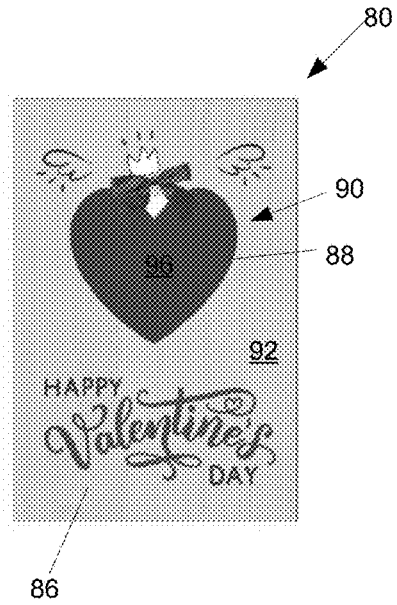
FIG. 14 is a front view of an alternative embodiment of a greeting card in accordance with the principles of the invention.
Figure 15:
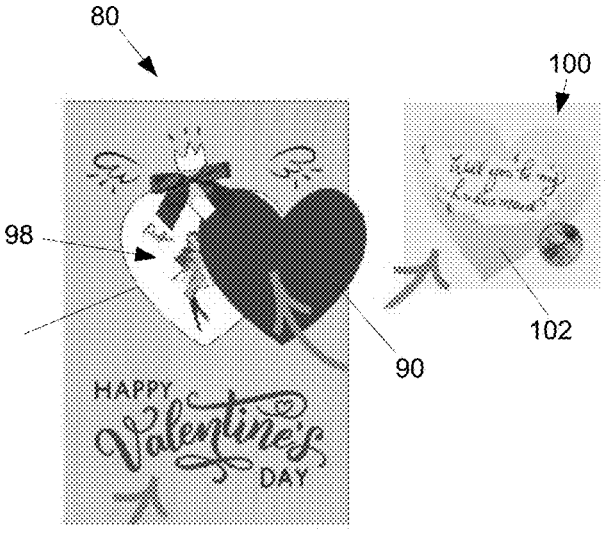
FIG. 15 is an exploded view of an alternative embodiment of a greeting card in accordance with the principles of the invention.
Figure 22:
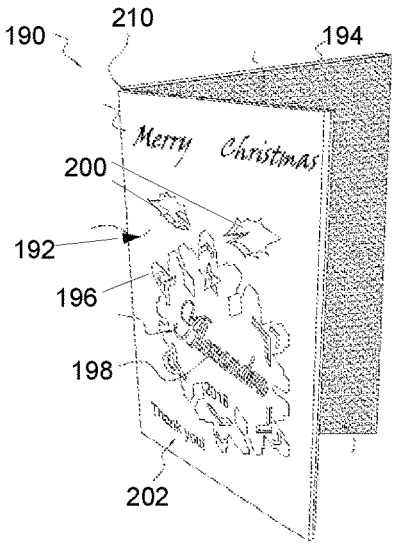
FIG. 22 is a perspective view of an alternative embodiment of a greeting card in accordance with the principles of the invention.
Figure 23:
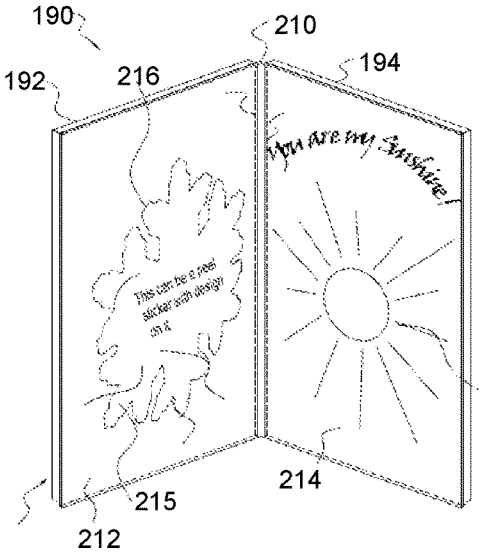
FIG. 23 is another perspective view of an alternative embodiment of a greeting card in accordance with the principles of the invention.

FIGS. 13-15 show another alternative embodiment of a greeting card 80 in accordance with the principles of the invention. Greeting card 80 is a single panel 82 having decorative images on both a first side 84 and a second opposite side 86. A cutline 88 defines a removable memento 90 which may be separated from the frame 92 of the panel 82. In this embodiment, the memento 90 is in the shape of a heart. On the first side 84, the memento 90 has a person's name engraved on it. On the first side 84, the frame 92 has decorative features that contrast with the memento 90. In this embodiment, a bottle of lavender oil 94 is included for application to the wood and Memento 90. On the second opposite side 86, the memento 90 has a removable sticker 96. The sticker 96 may be peeled away from the memento 90 to reveal a decorative image 98 on the memento 90. FIG. 15 includes an alternative memento 100 having a thin layer of material 102 applied to one side of the memento 100. A penny or other relatively hard object may be used to remove the layer of material 102 to reveal a message printed on the memento. Those skilled in the art will appreciate that both the removable sticker 96 and the thin layer material 102 serve the same purpose of hiding a message to a recipient to provide a surprise affect for the greeting card 80.

FIGS. 16 and 17 show another alternative embodiment of a greeting card 120 formed from a wooden panel 124 having a front side 126 and a backside 128. The backside 128 is covered by a sheet 130 that allows the greeting card 120 to function as a postcard, and the sheet includes an address, postage and a message, which in this case is a decorative image. The paper sheet 130 is colored red on the side facing the wooden panel 124. Portions of the wooden panel 124 are cut out to create a decorative three-dimensional image 140 on the front side 126.

Figure 24:
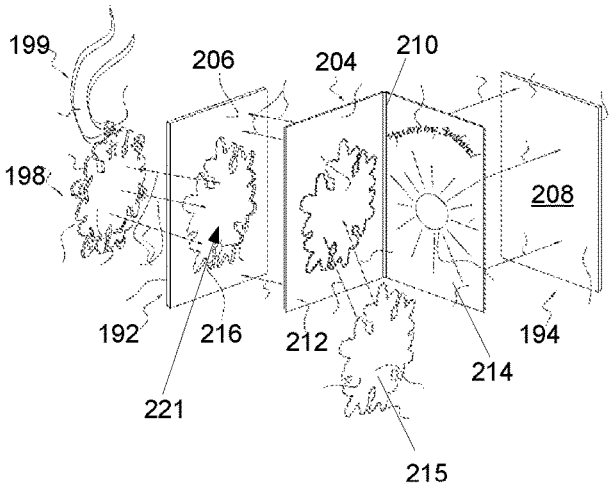
FIG. 24 is an exploded view of an alternative embodiment of a greeting card in accordance with the principles of the invention.
Figure 25:
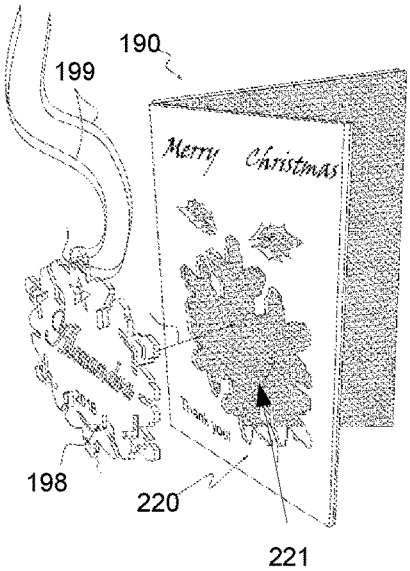
FIG. 25 is another perspective view of an alternative embodiment of a greeting card in accordance with the principles of the invention.
Figure 30:
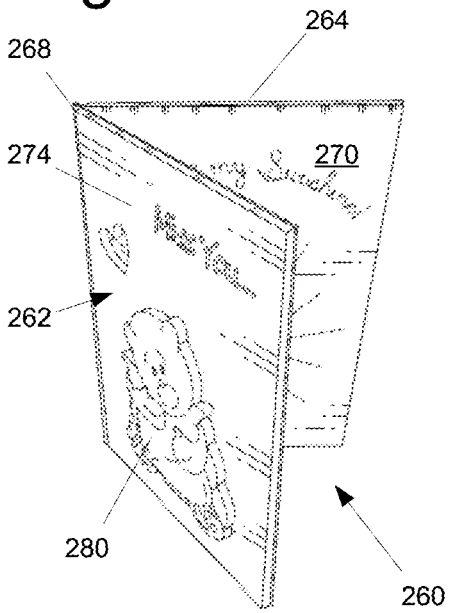
FIG. 30 is a perspective view of an alternative embodiment of a greeting card in accordance with the principles of the invention.
Figure 31:
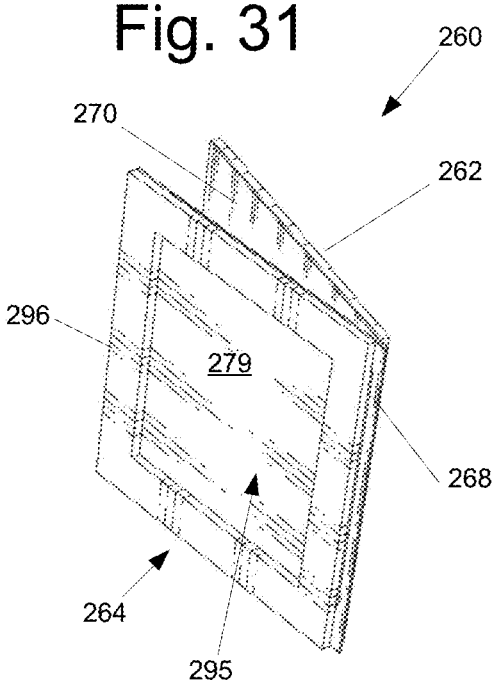
FIG. 31 is another perspective view of an alternative embodiment of a greeting card in accordance with the principles of the invention.
Figure 32:
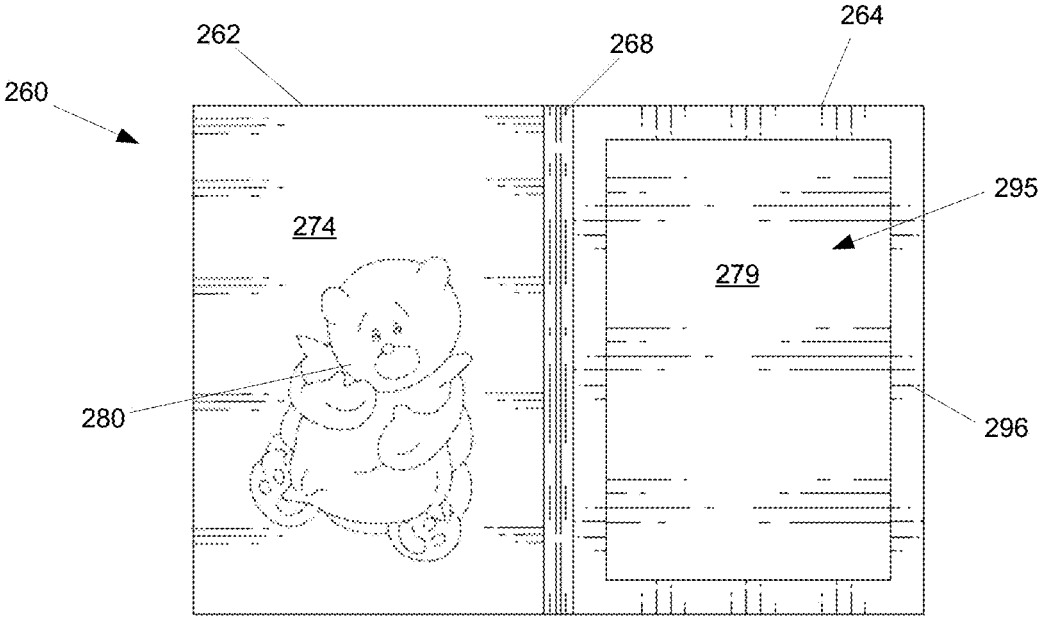
FIG. 32 is a front elevation view of an unfolded alternative embodiment of a greeting card in accordance with the principles of the invention.

Referring to FIGS. 18 and 19, a simple stand 144 formed from two interlocking arms to 146 may be sent with any of the greeting cards described herein, particularly greeting cards formed from only a single panel and/or greeting cards including a memento that is substantially rectangular, to allow a recipient to display the greeting card more easily, as shown specifically and FIGS. 24 and 27.

FIG. 20 shows another alternative embodiment of a greeting card 150 having a removable memento 152 defined by a continuous cutline 154 in accordance with principles of the invention. A sheet 156 spans across at least the opening 158 formed by removing the memento 152. An image 157 on the sheet 156 is visible and surrounded by the frame 159 through the opening 158. As with other embodiments, sheet 156 may be a paper sheet, wood panel, poster board or other material.

FIG. 21 shows another alternative embodiment of a greeting card 160 in accordance with principles of the invention. Greeting card 160 is a wood panel 162 having a continuous cutline 164 defining a frame 168 and a memento 170. The greeting card 160 may optionally include a paper sheet 172 affixed to its back surface which may include an image 174 visible when the memento 170 has been removed. In this embodiment, the cutline 164 is rectangular and forms a frame 168 having a uniform width 178. Optionally, the cut line 164 may form any shape including those shown in the previous Figures. The memento 170 of this embodiment has a decorative design 180 and a message 182 on its front surface 184. The wood panel 162 of the greeting card 160 may also optionally be used as the back panel on the greeting card formed from two wood panels connected by a sheet, as described below. Optionally, the memento 170 may be a postcard-type greeting card 120 as described in relation to FIGS. 16-19. The recipient of the greeting card 160 may use the memento 170 as a greeting card itself, which may be sent to the sender of the greeting card 160 or to a third person.

FIGS. 22-25 show an alternative embodiment of a greeting card 190 in accordance with principles of the invention. Greeting card 190 includes a front panel 192 and a back wooden panel 194. In this embodiment, the back panel 194 is a continuous panel, coextensive with the front panel 192 and without a removable memento. Optionally, the back panel 194 may include a memento defined by a cutline as shown and described in the previous embodiments. The front panel 192 includes a continuous cutline 196 defining a removable memento 198 as well as decorative openings 200 and text 202.

A sheet 204 is affixed to and extends across the inside surface 206 of the front panel 192 and the inside surface 208 of the back panel 194. The sheet 204, at least at the hinge 210, is flexible and allows the front and back panels 192 and 194 to rotate relative to each other about the hinge 210. A first section 212 of the sheet 204 is coextensive with the inside surface 206 of the front panel 192. In this embodiment, a second section 214 is coextensive with the inside surface 208 of the back panel 194 and the two sections of the sheet 204 are of equal size. The first section 212 of the sheet 204 includes a noncontinuous cutline 216 congruent to the cutline 196 of the front panel 192, so that the memento 198 may be punched out and removed. In this embodiment, a magnetic panel 215, coextensive with the memento 198 is attached to the first section 212 of the sheet 204 and allows the removed memento 198 to be adhered to metal surfaces. Optionally, a ribbon 199 may be used to suspend the memento 198, allowing it to be used as an ornament, necklace or other keepsake.

When the memento 198 and the section of the sheet 204 coextensive with the memento 198 on the first section 212 of the sheet 204 have been punched out, the remaining frame 220, defined as the portion of the front panel 192 surrounding the memento 198, defines an opening 221 through which the decorative features of the second section 214 of the sheet 204 may be viewed when the greeting card 190 is in the closed or partially closed position. The closed position is defined as the configuration where the front panel 192 and the back panel 194 lie flush against each other, with the hinge 210 folded to a 0° angle. In this embodiment, the fully open configuration is defined as the hinge 210 forming a 180° angle, that is, when the first section 212 and second section 214 of the sheet 204 are coplanar, as are the front and back panels 192 and 194. In this embodiment, the sheet 204 has a surface area equal to the inside surface 206 of the front panel 192 and the inside surface 208 of the back panel 194. As a result, the hinge 210 is only capable of bending between 0° and 180°.

FIGS. 26-32 show another alternative embodiment of a greeting card 260 in accordance with principles of the invention. Greeting card 260 includes a first panel 262 and a second panel 264 connected by a hinge 268 formed by a single sheet 270 attached to the inside of each of the panels 262 and 264 in a fashion similar to the greeting card 190 shown in FIGS. 22-25. In this embodiment, the sheet 270 is a single sheet having regions coextensive with the panels 262 and 264 separated by the hinge 268. However, greeting card 260 differs from the greeting card 90 in that the sheet 270 has a slightly a wider hinge 268 allowing the panels 262 and 264 to rotate a full 360° relative to each other. This allows the panels 262 and 264 to translate between an open configuration 271 shown in FIG. 28 and a closed configuration 273 shown in FIG. 29. In the open configuration 271, the panels 262 and 264 lie flush against each other with the sheet 270 sandwiched between them. In the closed configuration 273 the panels 262 and 264 lie flush against each other with the sheet 270 wrapped around both of the panels.

The exterior side 274 of the first panel 262 has a decorative element 280 attached to it. The decorative element 280 has a thickness that is less than or equal to a thickness of the second panel 264. The second panel 264 of this embodiment has a structure similar to the greeting card 160 shown in FIG. 21. Like greeting card 160, the second panel 264 has a continuous cutline 292 that defines a removable memento 294. When the memento is removed, the frame portion 296 of the second panel 264 forms an opening 295 through which any ornamentation on the exterior side 279 of the sheet 270 may be viewed. Optionally, both the first panel 262 and second panel 264 may have structures similar to the other panels described herein.

The opening 295 preferably has an adequate size and shape to accommodate the decorative element 280 attached to the exterior side 274 of the front panel 262. This allows the decorative element 280 be nested within the opening in the frame portion 296 of the back panel 264 when the panels of the greeting card 260 are arranged in the closed configuration shown in FIG. 29.

If the back panel 264 does not include a memento 294, or if the memento 294 has been removed, the greeting card 260 may be folded into the closed configuration 273 and mailed to a recipient. The closed configuration prevents damage to the decorative element 280. The frame portion 296 of the second panel 264 may also be used to frame an image such as a photograph or other ornamentation, thereby allowing the greeting card 260 to include decorative elements on both of its exterior sides. If the back panel 264 includes a memento 294, the removable memento 294 may optionally be a postcard similar to the greeting card 120 shown in FIGS. 16, 17 and 19.

Figure 33:
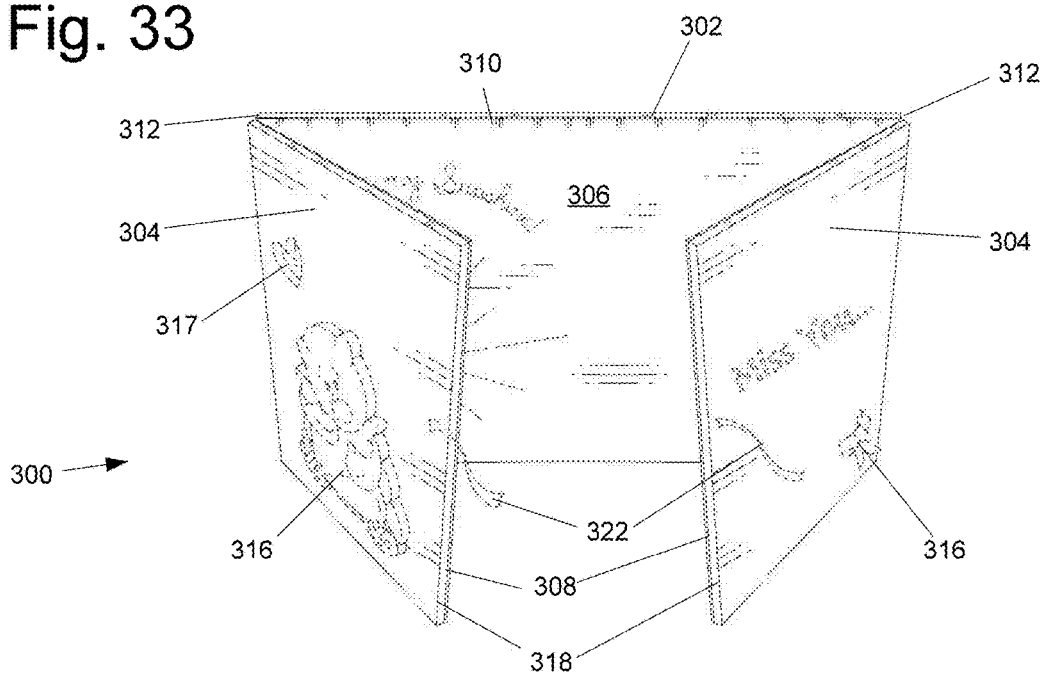
FIG. 33 is a perspective view of an alternative embodiment of a greeting card in accordance with the principles of the invention.

FIG. 33 shows another alternative embodiment of a greeting card 300 having a back panel 302 and two opposing front panels 304. Each of the two opposing front panels 304 is approximately half is wide as the back panel 302. A sheet 306 extends across the interior sides of the two opposing front panels 304 and across the interior side of the back panel 302, and forms two lateral hinges 312 on each side of the back panel 302. One or both of the front panels 304 may include one or more raised decorative elements 316. The panels 304 may also optionally include one or more decorative openings 317, as well as text and/or images. The medial ends 318 of the front panels 304 substantially abut when the greeting card 300 is folded such that the interior sides 308 of the front panels 304 lie flush against the interior side 310 of the back panel 302. The sheet 306 may be adorned with non-protruding decorative elements such as text and/or images. In this embodiment, two opposing ribbons 322 are attached to the two opposing front panels 304 at their medial ends 318 and may be tied into a simple knot or bow to hold the greeting card 300 closed.

Figure 34:
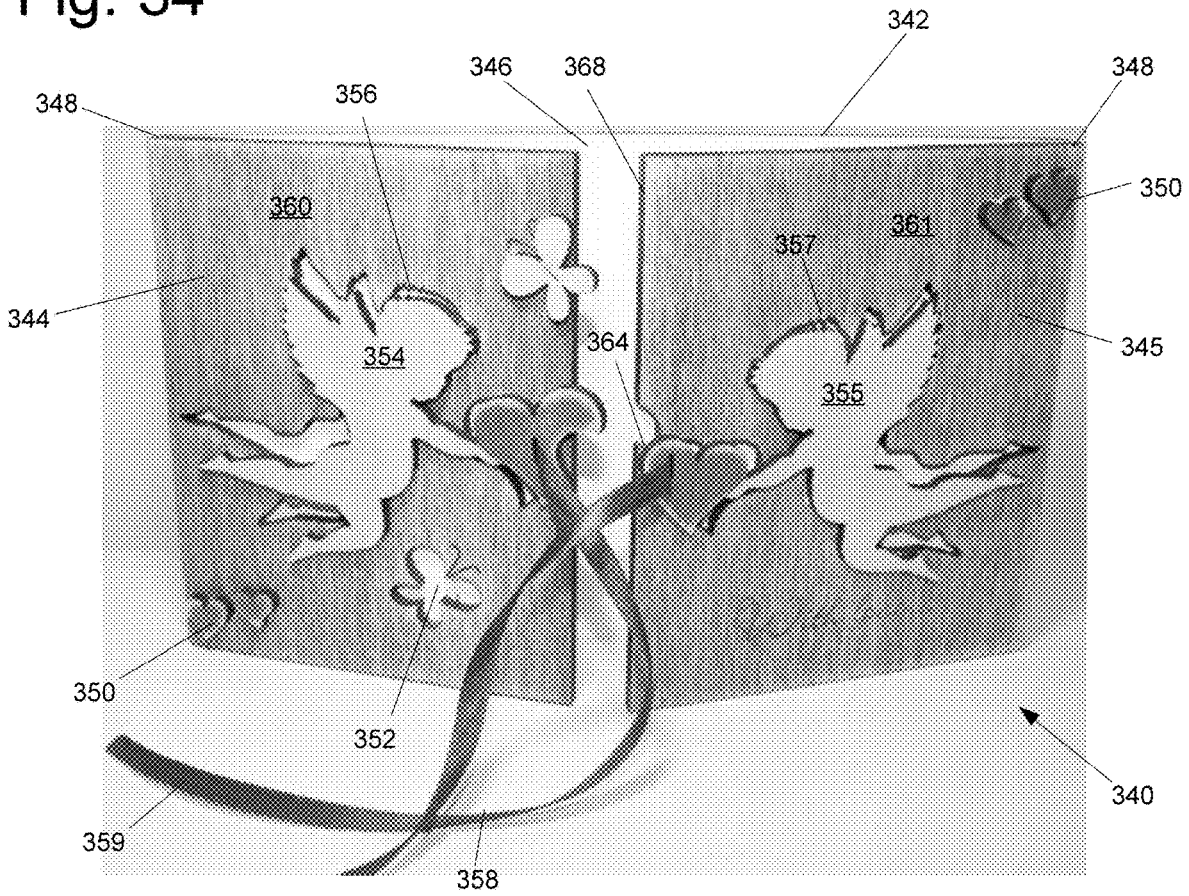
FIG. 34 is a perspective view of another alternative embodiment of the green card in accordance with principles of the invention.

FIG. 34 shows another alternative embodiment of the greeting card 340 also comprised of a back panel 342 which is approximately twice the size of each of the two opposing front panels 344 and 345. A sheet 346 extends across the interior sides of the front panels 344 and 345 and the back panel 342 in the same manner as described in reference to FIG. 33, and likewise forms two lateral hinges 348 that allow the greeting card 340 be opened and closed. In this embodiment, each of the two opposing front panels 344 and 345 includes raised decorative elements 350 and one of the front panels 344 includes a decorative opening 352.

The front panels 344 and 345 also include mementos 354 and 355 defined by cutlines 356 and 357, respectively. In this embodiment, the mementos 354 and 355 comprise silhouettes of cherubs holding hearts. Two ribbons 358 and 359 are attached to the mementos 354 and 355, respectively, as opposed to being attached to the frame portions 360 and 361, respectively. The ribbons 358 and 359 may be tied to hold the greeting card 340 in place, and this is only effective when the mementos 354 and 355 are incorporated into the panels 344 and 345. The cutline 356 defining the memento 354 on the front panel 344 is continuous but extends partially over the front panel 355. As a result, the memento 354 engages both of the front panels 344 and 345 when it is incorporated into the greeting card 340. A lip 364 on the lateral edge 368 of the front panel 345 is formed by the portion of the cutline 356 that extends into the front panel 345. As a result, the memento 354 locks the greeting card 340 and a closed position when it is inserted into the front panels 344 and 345.

Figure 35:
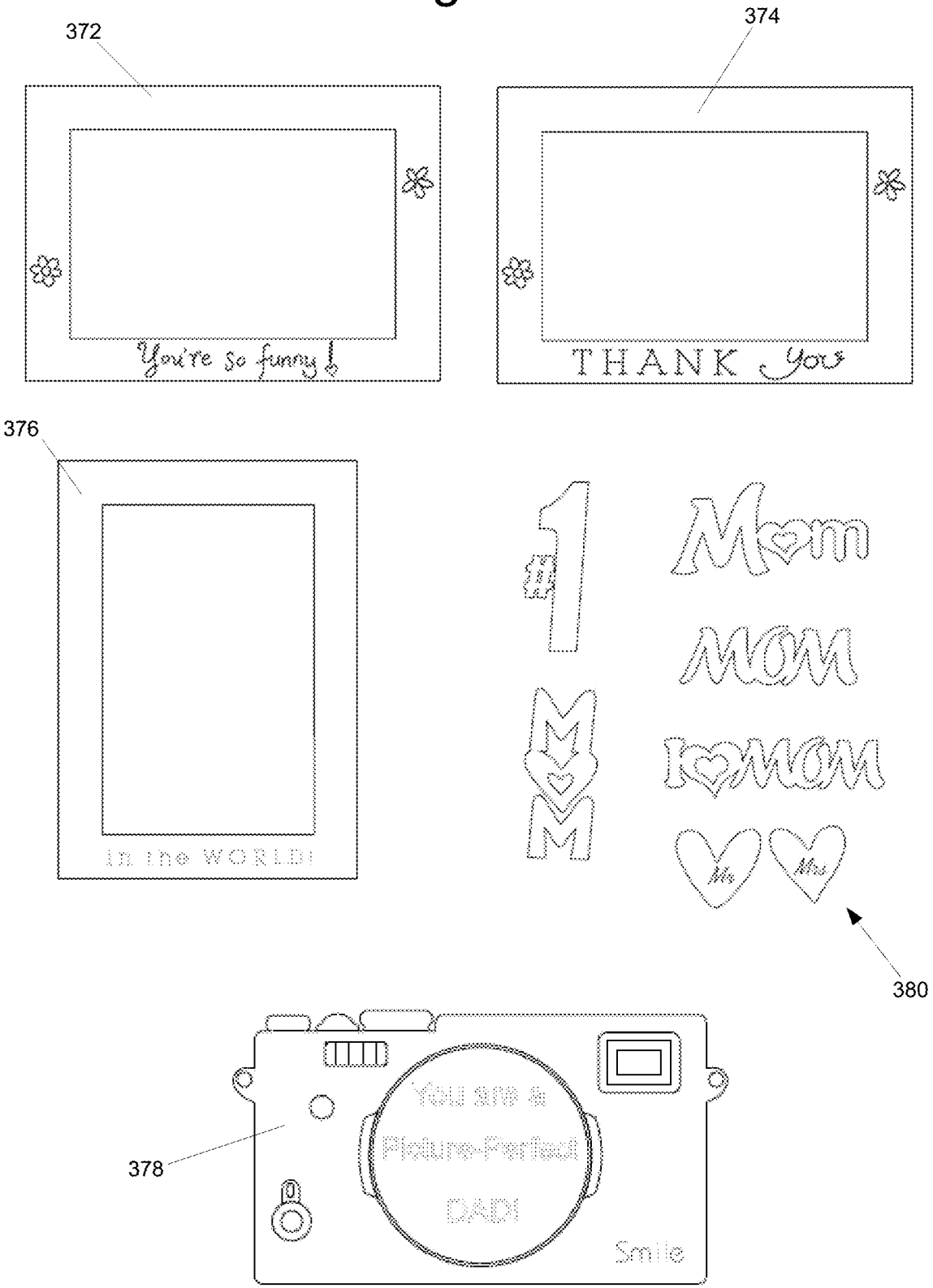
FIG. 35 is a front view of an alternative embodiments of frames and decorative elements for a greeting card in accordance with principles of the invention.

FIG. 35 shows additional exemplary nonlimiting frame portion configurations 372, 374, 376 and 378 and exemplary decorative elements 380 which may be attached to greeting cards in accordance with principles of the invention. The design shown are merely exemplary and nonlimiting. They show that there is a large variety of different configurations for both the greeting cards and decorative elements attached to them.

Whereas, the present invention has been described in relation to the drawings attached hereto, other and further modifications, apart from those shown or suggested herein, may be made within the spirit and scope of this invention. Those skilled in the art will appreciate that the conception, upon which this disclosure is based, may readily be utilized as a basis for the designing of other structures, methods and systems for carrying out the several purposes of the present invention. Descriptions of the embodiments shown in the drawings should not be construed as limiting or defining the ordinary and plain meanings of the terms of the claims unless such is explicitly indicated. The claims should be regarded as including such equivalent constructions insofar as they do not depart from the spirit and scope of the present invention.

The invention claimed is:

1. A greeting card having an integrated memento comprising:

a sheet having a first side and a second side;

a first panel having a perforated cutline defining a removable memento, and also defining an opening in a frame portion of the first panel when the memento is removed, wherein an internal side of the first panel is attached to the first side of the sheet at a first region of the sheet;

a second panel having a raised decorative element on an exterior side, and an internal side attached to the first side of the sheet at a second region of the sheet;

wherein the sheet forms a hinge between the first and second panels;

wherein the decorative element on the exterior side of the second panel has a thickness equal to or less than a thickness of the first panel, and the decorative element is sized to fit within the opening in the frame portion of the first panel;

an image on the first side of the first region of the sheet which is coextensive with the memento and viewable when the memento is removed;

wherein the frame portion of the first panel is adhered to the first side of the sheet; and wherein, after the memento is removed from the first panel, the greeting card rotates about the hinge to translate between an open position in which the first and second regions of the sheet lie flush against each other between the first panel and the second panel, and a closed position in which the exterior side of the first panel and the exterior side of the second panel lie flush against each other and the decorative element is nested within the opening in the first panel.

2. The greeting card of claim 1 wherein the memento is rectangular and when removed from the front panel, it functions as a mailable postcard.

3. The greeting card of claim 1 wherein the removable memento has one or more through holes, through which a ribbon may be inserted for the purpose of hanging.

4. The greeting card of claim 1 wherein said memento is a coaster.

* * * * *